United States Patent [19]

Kitaguchi et al.

[11] Patent Number: 5,076,502

[45] Date of Patent: Dec. 31, 1991

[54] SYSTEM FOR DISCRIMINATING RADIATION-CONTAMINATED FRAGMENTS AND APPARATUS FOR MEASURING RADIOACTIVITY OF FRAGMENTS

[75] Inventors: Hiroshi Kitaguchi, Ibaraki; Shigeru Izumi, Tokyo; Hideo Yusa, Katsuta; Makoto Kikuchi, Hitachi, all of Japan

[73] Assignee: Hitachi, Ltd., Tokyo, Japan

[21] Appl. No.: 453,946

[22] Filed: Dec. 19, 1989

[30] Foreign Application Priority Data

Dec. 21, 1988 [JP] Japan ..... 63-320686
Mar. 20, 1989 [JP] Japan ..... 1-066228

[51] Int. Cl.[5] ..... B02C 4/42

[52] U.S. Cl. ..... 241/36; 209/576; 209/589; 209/655; 241/101.2; 241/DIG. 38

[58] Field of Search ..... 241/DIG. 38, 24, 30, 241/80, 97, 101.2, 79.1, 79, 36; 209/3, 5, 76, 589, 655, 657, 924; 73/293

[56] References Cited

U.S. PATENT DOCUMENTS 4,361,238 11/1982 Kealy et al. ..... 209/576
4,363,722 12/1982 Dresty et al. ..... 209/589 X
4,591,716 5/1986 Kitaguchi et al. .
4,646,978 3/1987 Johnson et al. ..... 241/24
4,679,738 7/1987 Prisco et al. ..... 209/589 X

FOREIGN PATENT DOCUMENTS 119977 7/1977 Japan .
15578 1/1985 Japan .
757192 8/1980 U.S.S.R. ..... 209/589
1346566 2/1974 United Kingdom ..... 209/589

OTHER PUBLICATIONS

Japan Atomic Energy Assocation Journal, vol. 29, No. 11, 1987, p. 60.

*Primary Examiner*—Mark Rosenbaum
*Attorney, Agent, or Firm*—Antonelli, Terry & Stout & Kraus

[57] ABSTRACT

A system for discriminating radiation-contaminated fragments on the basis of a predetermined radioactive concentration includes a detection device for detecting the radiation of the fragments, the detection device having a generally vertically-extending path of transfer of the fragments, at least one radiation detector disposed at one of the inside and outside of asid transfer path, and a transfer device for sequentially transferring the fragments in the transfer path; a convey device for conveying the fragments to said detection device; and a controller for determining the radioactive concentration of the fragments in accordance with the radiation detected by the detection device and for judging whether or not the radioactive concentration of the fragments is the predetermined radioactive concentration. The controller is also operable to control the transfer device so as to adjust the speed of transfer of the fragments in the transfer path. The system further includes a density detecting device for detecting the density of the fragments to be conveyed to the detection device. The controller corrects the above determined radioactive concentration by the density detected by the density detecting device.

44 Claims, 6 Drawing Sheets

SYSTEM FOR DISCRIMINATING RADIATION-CONTAMINATED FRAGMENTS AND APPARATUS FOR MEASURING RADIOACTIVITY OF FRAGMENTS

BACKGROUND OF THE INVENTION

This invention relates generally to a system for discriminating a radiation-contaminated material and an apparatus for measuring the radioactivity of such material, and more particularly to a system for discriminating radiation-contaminated, fragmented material and an apparatus suited for measuring the radioactivity of such fragmented material.

In reactor facilities, a large amount of fragmented or broken waste (e.g., concrete waste) contaminated by radiation to a very low level is produced when the reactor is discarded. Therefore, it is necessary to accurately measure the radioactivity of such fragmented waste and also to discriminate the fragmented waste in a short time.

One example of a fragmented material discriminating system, as well as an apparatus for measuring the radioactivity of the fragmented material, is disclosed in FIGS. 3 and 4 of Japan Atomic Energy Association Journal (Vol. 29, No. 11 (1987), Page 60). In this conventional example, fragmented concrete waste, produced as a result of breaking a building structure, is passed through a radiation detector by a belt conveyor extending through the radiation detector. At this time, the radioactivity of the fragmented waste is detected. The radioactive concentration of the waste fragments is expediently estimated from the counting rate of the radiation detector and the empirically-obtained density of the fragments. Based on the radioactive concentration thus expediently estimated, the waste fragments are discriminated at the distal end of the belt conveyor.

In the measurement of radioactivity, the background count is proportional to the volume of the detector. In the measurement of radioactivity of a very low level, $^{40}K$ contained in the detector is also a major factor for the background count, and its influence is proportional to the volume of the detector.

The lower limit value D ($\mu$ci/g) of the detection of the radioactivity is represented by the formula, $D=K\cdot Ns$, where K (($\mu$ci/g)/cps) represents the radioactive concentration conversion factor, and Ns represents the limit counting rate. The radioactive concentration conversion factor depends on the reciprocal of the measurement efficiency (including the absolute efficiency and geometrical efficiency of the detector) of the measurement system. If the count after a time t is Nm, and the background count is nb, then the net count N can be represented by $(Nm-nb)$. $(N\approx nb)$ is obtained around the detection limit value, and therefore the standard deviation $\sigma_t$ is represented by the following formula:

$$\sigma_t \approx \sqrt{Nm + nb} = \sqrt{2nb}$$

If the limit count is $3\sigma_t$, then its limit counting Ns is $3\sqrt{2nb/t}$. Therefore, the detection lower limit value D is $K\cdot 3\sqrt{2nb/t}$.

Even if the object to be measured is so arranged as to be completely surrounded by the detector, the geometrical efficiency will not exceed the maximum of 100%. It will be appreciated from this that when the measurement time t of the measurement system is kept constant, the decrease in the background count nb is an important point for the low-level measurement. In other words, the detection lower limit value becomes smaller in proportion to the one-half power of the background counting rate.

The measurement precision is influenced by the density of the fragmented material (object to be measured).

Therefore, in order to accurately measure the radioactivity of the fragmented material, it is necessary to know the density of the fragmented material in the radiation detector.

In the above prior art, since the radiation detector surrounds the belt conveyor, its volume is large. Therefore, the background counting rate is large, and the detection lower limit value is large. Therefore, the radioactivity of a very low level can not be measured. In other words, the measurement sensitivity is low, and hence the discrimination of the fragments can not be carried out in a short time. Further, when the radioactive concentration is to be determined from the radiation count, the empirically-obtained density is used, and therefore the results of the measurement of the radioactive concentration merely serve as expedient ones.

SUMMARY OF THE INVENTION

It is therefore an object of this invention to provide a system for discriminating radiation-contaminated, fragmented material on the basis of a predetermined radioactive concentration, which system is capable of accurately carrying out such discrimination in a short time.

Another object is to provide an apparatus capable of accurately measuring the radioactivity of the fragmented material in a short time.

According to a first aspect of the present invention, there is provided a system for discriminating radiation-contaminated fragments on the basis of a predetermined radioactive concentration, comprising:

(a) detection means for detecting the radiation of the fragments, the detection means comprising means constituting a path of transfer of the fragments, at least one radiation detector disposed at one of the inside and outside of the transfer path, and a transfer device for sequentially transferring the fragments in the transfer path;

(b) convey means for conveying the fragments to the detection means; and (c) a controller for determining the radioactive concentration of the fragments in accordance with the radiation detected by the detection means and for judging whether or not the radioactive concentration of the fragments is a predetermined radioactive concentration, the controller also being operable to control the transfer device so as to adjust the speed of transfer of the fragments in the transfer path.

The system further comprises a density detecting device for detecting the density of the fragments to be conveyed to the radiation detector, the controller correcting the determined radioactive concentration by the density detected by the density detecting device.

The system further comprises adjustment means for adjusting the particle size of the fragments before the fragments are conveyed to the detection means.

The system further comprises a sorter responsive to a signal from the controller so as to sort the fragments, discharged from the detection means, on the basis of the predetermined radioactive concentrations.

The system further comprises a level detecting device for detecting the level of the fragments in the transfer path, and a roll mill for crushing the fragments, the controller controlling the operation of the roll mill in accordance with the level detected by the level detecting device so that the crushing speed of the roll mill is adjusted.

According to a second aspect of the present invention, there is provided a system for discriminating radiation-contaminated fragments on the basis of a predetermined radioactive concentration, comprising:

(a) a selector for dividing the fragments into a plurality of groups according to predetermined particle sizes;

(b) a plurality of detection means for detecting the radiations of the groups of the fragments, respectively, each of the plurality of detection means comprising means constituting a path of transfer of the corresponding group of the fragments, at least one radiation detector disposed at one of the inside and outside of the transfer path, and a transfer device for sequentially transferring the corresponding group of the fragments in the transfer path;

(c) a plurality of convey means for conveying the groups of the fragments to their corresponding detection means, respectively; and (d) a controller for determining the radioactive concentration of each group of the fragments in accordance with the radiation detected by a respective one of the detection means and for judging whether or not the radioactive concentration of each group of the fragments is a predetermined radioactive concentration, the controller also being operable to control each of the transfer devices so as to adjust the speed of transfer of each group of the fragments in the transfer path.

The system of the second aspect further comprises a plurality of sorter means associated respectively with the plurality of detection means, each sorter means being responsive to a signal from the controller so as to sort the corresponding group of the fragments, discharged from the corresponding detection means, on the basis of the predetermined radioactive concentration.

The system of the second aspect further comprises a plurality of level detecting devices for respectively detecting the levels of the groups of the fragments in the respective transfer paths, and a plurality of roll mills for crushing the groups of the fragments, respectively, the controller controlling the operation of each of the roll mills in accordance with the level detected by a respective one of the level detecting devices so that the crushing speed of the roll mill is adjusted.

According to a third aspect of the present invention, there is provided a system for discriminating radiation-contaminated fragments on the basis of a predetermined radioactive concentration, comprising:

(a) detection means for detecting the radiation of the fragments;

(b) convey means for conveying the fragments to the detection means;

(c) density detecting means for detecting the density of the fragments to be conveyed to the detection means; and (d) a controller for determining the radioactive concentration of the fragments in accordance with the radiation detected by the detection means and the density detected by the density detecting means and for judging whether or not the radioactive concentration of the fragments is a predetermined radioactive concentration.

The system of the third aspect further comprises adjustment means for adjusting the particle size of the fragments before the fragments are conveyed to the detection means.

According to a fourth aspect of the present invention, there is provided apparatus for measuring the radioactivity of radiation-contaminated fragments, comprising:

(a) means constituting a path of transfer of the fragment;

(b) at least one radiation detector disposed at one of the inside and outside of the transfer path;

(c) a transfer device for sequentially transferring the fragments in the transfer path; and (d) a controller for determining the radioactive concentration of the fragments in accordance with the radiation detected by the detection means and for judging whether or not the radioactive concentration of the fragments is a predetermined radioactive concentration, the controller also being operable to control the transfer device so as to adjust the speed of transfer of the fragments in the transfer path.

DESCRIPTION OF THE PREFERRED EMBODIMENTS OF THE INVENTION

Figure 7:
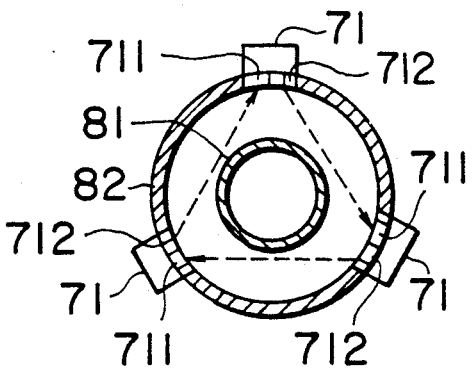
FIG. 7 is a schematic plan view showing a level detecting device.

A first preferred embodiment of a fragment material-discriminating system of the present invention will now be described with reference to FIGS. 1, 2 and 7.

Figure 1:
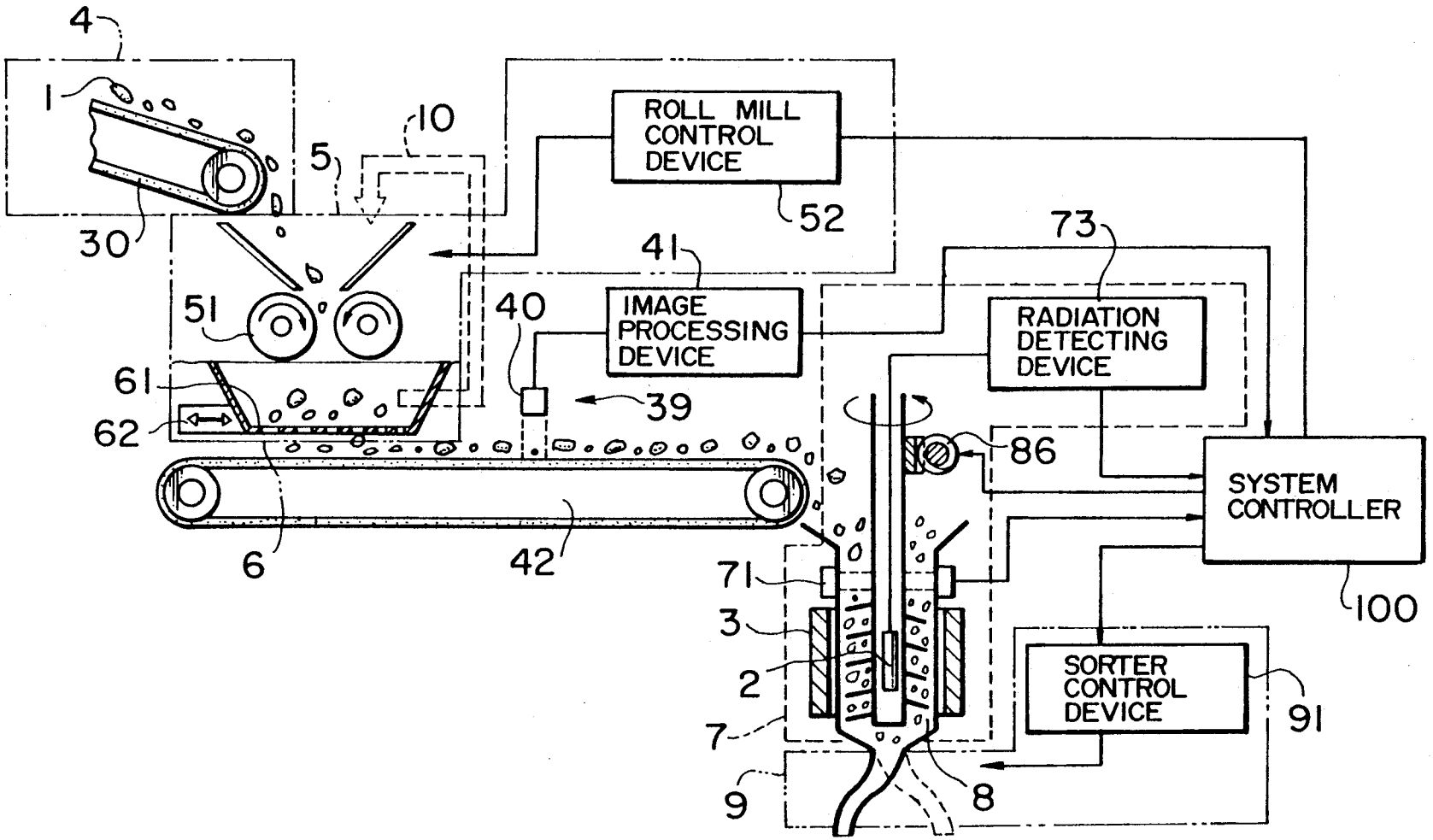
FIG. 1 is a schematic view of a first embodiment of a fragment-discriminating system of the present invention.

The fragmented material-discriminating system shown in FIG. 1 comprises a conveyor device 4 for conveying a broken or fragmented material 1 from the place where the material is broken into pieces, a crusher 5 for further breaking the fragmented material 1 into smaller fragments or particles, a selector 6 for selecting those of the thus crushed fragments 1 having particle sizes less than a predetermined value, a belt conveyor 42 for conveying the thus selected fragments 1 of less than the predetermined particle size to a radiation measuring device 7, a density detecting device 39 for detecting the density of the fragments 1 on the belt conveyor 42, and the radiation measuring device 7 for measuring the radioactivity of the fragments 1 of less than the predetermined particle size, a sorter 9 for sorting the fragments 1 on the basis of a predetermined radioactive concentration after the above measurement, and a system controller 100 for determining the radioactive concentration from the radiation value detected by the radiation measuring device 7, and for correcting the thus determined radioactive concentration by the density detected by the density detecting device 39, and for controlling the sorter 9 in accordance with the corrected radioactive concentration. The controller 100 also controls the transfer of the fragments 1 in the radiation measuring device 7.

The crusher 5 comprises a roll mill 51 and a roll mill control device 52 for controlling the roll mill 51. The selector 6 comprises a screen 61 of a predetermined mesh size, a Vibrator 62 for vibrating the screen 61 horizontally, and a return device 10 for returning those fragments 1 of more than the predetermined particle size to the crusher 5. The screen 61 is inclined, and the return device 10 comprises a belt conveyor for conveying the fragments 1 of more than the predetermined particle size collecting at the lower portion of the screen 61.

The density measuring device 39 comprises a television camera 40 for picking up the image of the fragments 1 on the belt conveyor 42, and an image processing device 41 for calculating the average particle size of the fragments 1 from the image picked up by the television camera 40.

Figure 2:
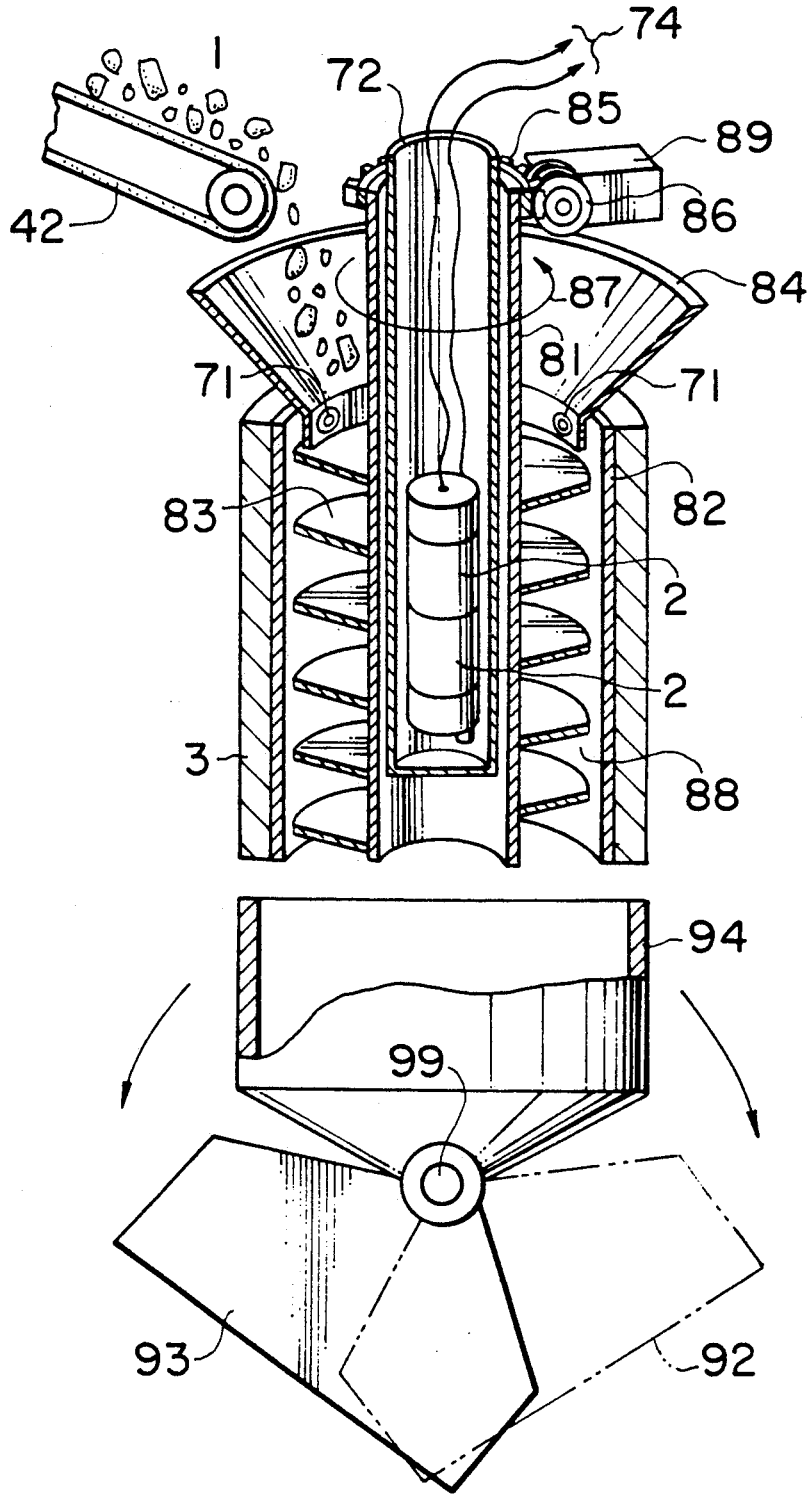
FIG. 2 is a schematic, vertical cross-sectional view showing a radiation measuring device and a sorter of the system.

As shown in FIG. 2, the radiation measuring device 7 comprises an outer tube 82 extending substantially vertically, and an inner tube 81 received in the outer tube 82. The space of an annular cross-section between the peripheral walls of the outer and inner tubes 82 and 81 is sufficiently large to provide a path 88 of transfer of the fragments 1. A shield member 3 is mounted on the outer peripheral surface of the outer tube 82. Mounted on the upper end of the outer tube 82 is a funnel-like guide member 84 for guiding the fragments 1 fed from the belt conveyor 42. The inner tube 81 is rotatable about its axis in a direction indicated by an arrow 87 in FIG. 2, and a spiral blade 83 is fixedly mounted on the outer peripheral surface of the inner tube 81. These members jointly constitute a transfer device. A gear 85 is fixedly mounted on the outer peripheral surface of the inner tube 81 adjacent to the upper end thereof, and is in mesh with a gear 86 which is driven by a motor 89. A support tube 72 is inserted in the inner tube 81 in such a manner that the support tube 72 is held out of contact with the inner tube 81. Radiation detectors 2 are supported within the support tube 72. In the embodiment shown in FIG. 2, the two radiation detectors 2 are supported along the support tube 72 but it may be one detector in response to the need. The radiation detectors 2 are connected to a radiation detecting device 73 by wires 74.

A level detecting device 71 is provided at the upper end portion of the radiation measuring device 7. As shown in FIG. 7, the level detecting device 71 comprises photodiodes 711, and light-emitting diodes 712 which are disposed in horizontally opposed relation to the photodiodes 711. In the embodiment of FIG. 7, three pairs of photodiodes 711 and light-emitting diodes 712 are used. The light-emitting diodes 712 are so arranged that the rays of light from the light-emitting diodes 712 are not interrupted by the support tube 72. When the level or height of the fragments 1 in the transfer path 88 of the radiation measuring device 7 is below a predetermined level, the light emitted from each light-emitting diode 712 reaches its mating photodiode 711, so that the photodiode 711 produces an output signal.

The sorter 9 is disposed below the radiation measuring device 7, and comprises a bucket 94 pivotally mounted at its bottom on a shaft 99, and a sorter control device 91 for controlling the pivotal movement of the bucket 94.

The operation of the above system will now be described.

The fragmented material 1 is conveyed by a belt conveyor 30 of the conveyor device 4 to the roll mill 51 from the place where the material is broken into fragments, and the fragmented material is further broken by the roll mill 51 into smaller fragments or particles and is fed to the screen 61 The screen 61, which is subjected to horizontal vibrations, selects those fragments 1 of less than the predetermined particle size and allows them to pass therethrough. Those fragments 1 of more than the predetermined particle size are returned to the roll mill 51 by the return device 10. Subsequently, the thus selected fragments 1 are conveyed by the belt conveyor 42 and are introduced into the transfer path 88 of the radiation measuring device 7. At this time, the inner tube 81 is being rotated by the motor 89, so that the spiral blade 83 fixedly mounted on the outer peripheral surface of the inner tube 81 is also rotating. Therefore, the thus introduced fragments 1 are sequentially moved by the propelling force of the blade 83 toward the bottom of the transfer path 88. During this downward movement of the fragments 1 along the transfer path 88, the radiation detectors 2 supported within the support tube 72 detect the radiation of the fragments 1, and feed the detection result to the radiation detecting device 73. The radiation detecting device 73 feeds the detected radiation value to the system controller 100.

The density detecting device 39 picks up the image of the fragments 1 on the belt conveyor 42 by the television camera 40, and the image processing device 41 determines the average particle size of the fragments 1 in accordance with the image thus picked up, and feeds the result to the system controller 100. The system controller 100 calculates or determines the radioactive concentration of the fragments 1 from the radiation value detected by the radiation detecting device 73. The system controller 100 also calculates or determines the density of the fragments 1 from the average particle size detected by the density detecting device 39. The system controller 100 corrects the calculated radioactive concentration in accordance with the calculated density to determine an accurate radioactive concentration. In accordance with the corrected radioactive concentration, the system controller 100 feeds an instruction signal to the sorter control device 91 so as to pivotally move the bucket 94 in one of predetermined directions (for example, in one direction indicated by reference numeral 92 when the radioactive concentration is above a predetermined level, and in the other direction indicated by reference numeral 93 when the radioactive concentration is not more than the predetermined level), thereby discriminating or separating those fragments 1 of above the predetermined radioactive concentration from the remainder of not more than such concentration level. The above instruction signal is of such a nature that the time interval between the time when the fragments 1 arrive at the radiation detectors 2 and the time when the fragments 1 arrive at the sorter 9 is taken into account.

Variations in the amount of transfer of the fragments 1 past the surroundings of the radiation detectors 2 affect the precision of the radiation measurement. The speed of transfer of the fragments 1 along the transfer path 88 is kept constant by the spiral blade 83, and therefore the precision of the measurement can be enhanced by controlling the amount of the fragments 1 introduced into the transfer path 88. The control of this amount is achieved through the system controller 100 which is responsive to the signal from the level detecting device 71 so as to control the crushing rate or speed of the roll mill 51. In the case where the distance between the roll mill 51 and the radiation measuring device 7 is a relatively great, the conveyance speed of the belt conveyor 42 may be controlled in addition to the above crushing rate.

As described above, because of the provision of the density detecting device 39 for detecting the density of the fragments 1, the radioactive concentration of the fragments 1 can be measured highly precisely. Further, since the radiation detectors 2 are mounted inside the transfer path 88, the volume of the radiation detectors 2 can be reduced. For example, the diameter of the radiation detector 2 is 2 to 3 inches provided that it is intended to detect $^{60}Co$ contained in the fragments 1. In the radiation measuring device shown in FIG. 2, the two radiation detectors are used. The combined volume of the two radiation detectors is about one-hundredth (1/100) of that of the conventional radiation detector. As a result, the background counting rate is one-hundredth (1/100) of that of the prior art, and the detection lower limit value is one-tenth (1/10). Therefore, the measurement of a very low level radiation can be made. What the detection lower limit value of 1/10 the prior art is means that the measurement sensitivity is increased by ten times, and the time required for the discrimination of the fragments can be reduced to 1/10 as compared with the prior art. Further, since the radiation detectors 2 are supported within the support tube 72 which is inserted in the inner tube 81 in spaced apart relation to the inner tube 81, vibrations produced when the fragments 1 are transferred are not transmitted to the radiation detectors 2, thereby preventing the generation of noise signals.

Modifications of the radiation measuring device and the sorter will now be described with reference to FIGS. 3 to 6.

Figure 3:
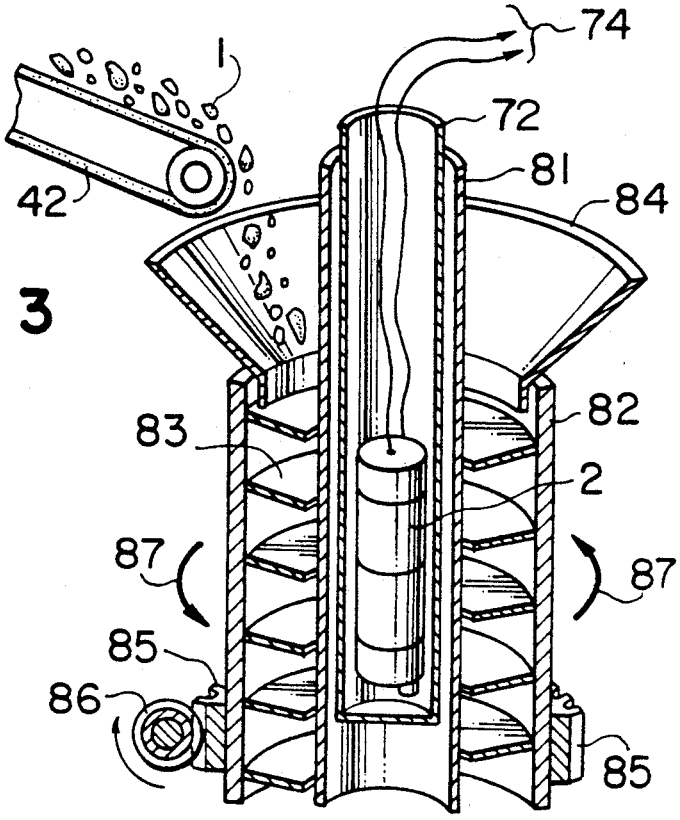
FIG. 3 is a vertical cross-sectional view of a modified radiation measuring device.

A radiation measuring device shown in FIG. 3 is a modification of the radiation measuring device shown in FIG. 2. An outer tube 82 is rotatable about its axis, and a spiral blade 83 is fixedly secured to the inner peripheral surface of the outer tube 82. A gear 85 is fixedly mounted on the outer peripheral surface of the outer tube 82, and is in mesh with a gear 86 which is driven by a motor. Except for these, the radiation measuring device of FIG. 3 is of the same construction as that of the radiation measuring device of FIG. 2. When the blade 83 rotates together with the outer tube 82, the fragments 1 are sequentially transferred toward the bottom of the transfer path, and the radiation of the fragments 1 is detected by the radiation detectors 2.

A radiation measuring device of FIG. 4 differs from the radiation measuring device of FIG. 2 in that it is not provided with the spiral blade 83, and that a hopper 95 is provided below the path 88 of tranfer of the fragments, the hopper 95 being reciprocally movable in a first direction indicated by a double-head arrow and also in a second direction perpendicular to the first direction (that is, in a direction perpendicular to the sheet of FIG. 4). The fragments 1 are transferred along the transfer path 88 under the influence of the gravity, and the hopper 95 is responsive to an instruction signal from a system controller 100 (not shown) so as to discriminate the fragments 1 on the basis of the predetermined radioactive concentration, and discharges the discriminated fragments 1 into respective ones of two containers 200. When this discharge is effected, the fragments 1 in the transfer path 88 are moved downward under the influence of the gravity. Thus, the hopper 95 serves as a transfer device and a sorter.

Figure 5:
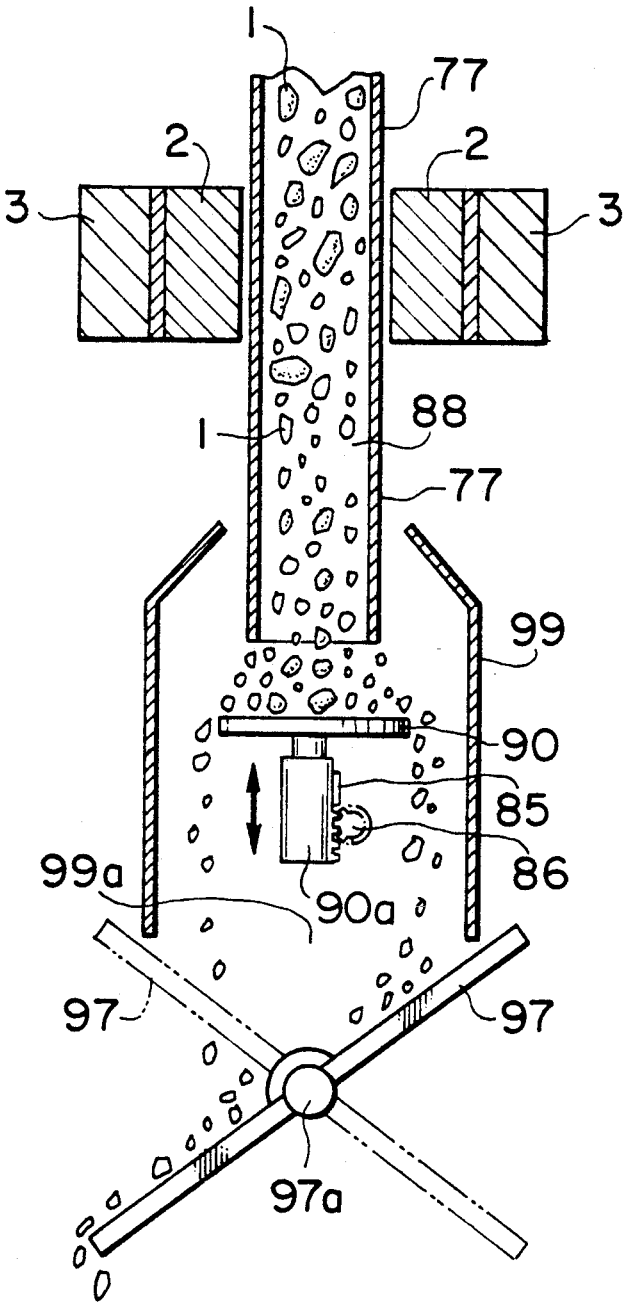
FIG. 5 is a schematic, vertical cross-sectional view showing a further modified radiation measuring device and another modified sorter.

In a radiation measuring device shown in FIG. 5, a path 88 of transfer of the fragments is defined by a tube 77 extending substantially vertically. Radiation detectors 2 are arranged in surrounding relation to the tube 77, and a horizontal plate 90 is disposed below the tube 77. A vertically-extending rack 85 is connected to the horizontal plate 90 through a connecting member **90*a* secured to the lower surface of the horizontal plate 90. A pinion 86 is in mesh with the rack 85, and is fixedly connected to a rotatable drive shaft of a motor (not shown). The height of the horizontal plate 90 is adjusted by rotating the pinion 86**.

The fragments 1 in a transfer path 88 are moved downward under the influence of the gravity. The speed of downward movement of the fragments 1 can be adjusted by vertically moving the horizontal plate 90 to adjust the gap between the tube 77 and the horizontal plate 90. During the downward movement of the fragments 1 along the transfer path 88, the radiation of the fragments 1 is detected by the radiation detectors 2.

Since the radiation detectors 2 in this embodiment surround only the fragments 1, the combined volume of the radiation detectors 2 is about one-fourth ($\frac{1}{4}$) of that of the prior art radiation detector which surrounds a belt conveyor (transfer device) in addition to the fragments. Therefore, with a simple construction, the background counting rate can be reduced to one-fourth ($\frac{1}{4}$) of that of the prior art.

A sorter shown in FIG. 5 comprises a cover 99 surrounding the horizontal plate 90 and having an opening **99*a* at its lower end, an angularly movable shaft 97*a* mounted horizontally below the opening 99*a*, a flat plate 97 fixedly secured to the angularly movable shaft 97*a*, and a motor (not shown) for angularly moving the shaft 97*a* about its axis. The shaft 97*a* is disposed parallel to the flat plate 97 and passes through the center of the flat plate 97. In accordance with an instruction from a system controller 100 (not shown), the shaft 97*a* is angularly moved to discriminate the fragments 1 on the basis of the predetermined radioactive concentration. For example, when the radioactive concentration of the fragments 1 is above the predetermined level, the flat plate 97 is angularly moved to a position indicated by a solid line in FIG. 5. In contrast, when the radioactive concentration of the fragments 1 is not more than the predetermined level, the flat plate 97 is angularly moved to a position indicated by a broken line. Thus, the sorter discriminates the fragments 1**.

Figure 6:
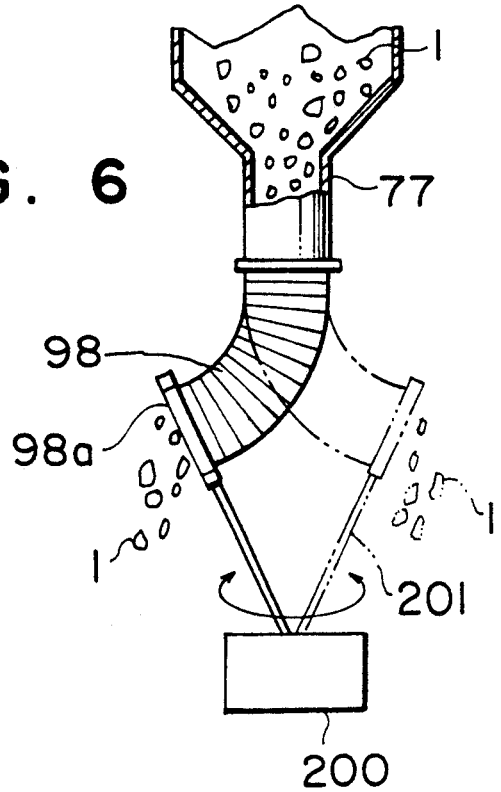
FIG. 6 is a schematic, vertical cross-sectional view showing a further modified sorter.

A sorter shown in FIG. 6 comprises a flexible tube 98 connected to an outlet of a tube 77 constituting a fragment transfer path 88 of the gravity drop-type, and a change device 202 for changing the bending of the flexible tube 98 and the direction of a discharge port **98*a* of the flexible tube 98. The change device 202 includes a telescopic member 201 connected at its distal end to the discharge port 98***a* of the flexible tube 98. The length of the telescopic member 201 is variable, and the telescopic member 201 is angularly movable as indicated by an arrow. In accordance with an instruction from a system controller 100 (not shown), the change device 202 angularly moves the telescopic member 201 to change the direction of the discharge port 98*a* of the flexible tube 98, thereby discriminating the fragments 1 on the basis of the predetermined radioactive concentration. Also, in accordance with an instruction from the system controller 100, the change device 202 changes the length of the telescopic member 201 to change the degree of bending of the flexible tube 98. When the flexible tube 98 is bent to a large degree, the discharge rate (that is, the transfer speed) is decreased. In contrast, when the flexible tube 98 is bent to a small degree, the discharge rate is increased. The sorter also serves as a transfer device for transferring the fragments.

Figure 4:
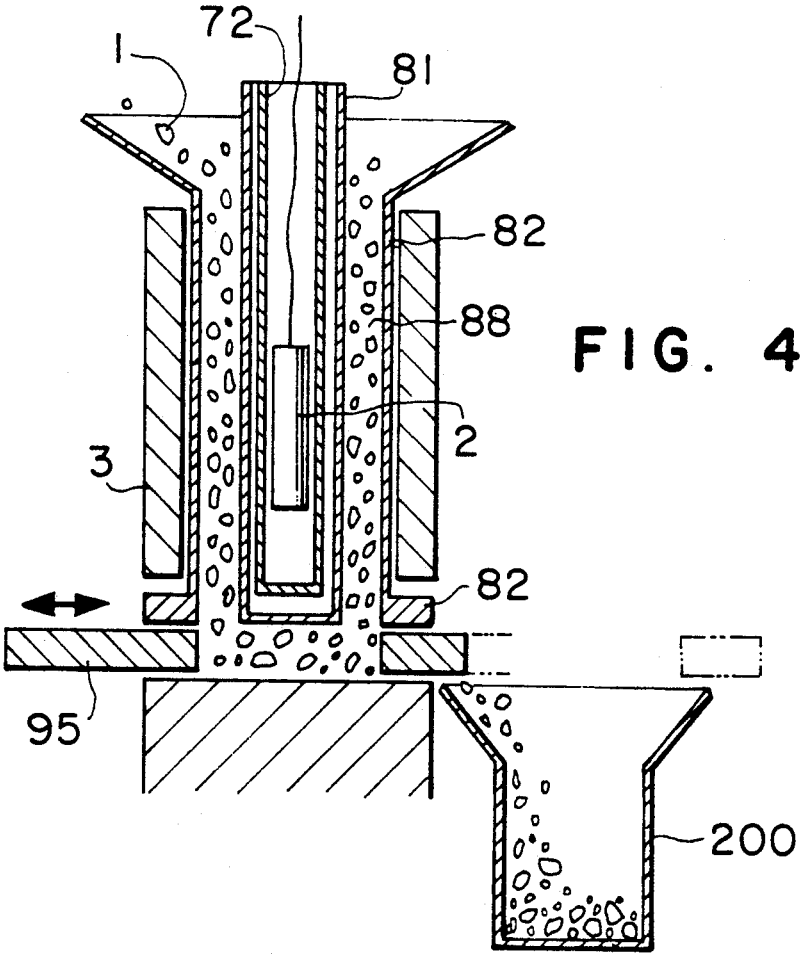
FIG. 4 is a vertical cross-sectional view showing another modified radiation measuring device and a modified sorter.

It is to be noted that the pivotal bucket 94 of FIG. 2, the reciprocal hopper 95 of FIG. 4, the angularly movable flat plate 97 of FIG. 5 and the flexible tube 98 of FIG. 6 can be used in combination with the radiation measuring devices of FIGS. 2, 3, 4 and 5.

Next, modifications of the level detecting device and the density detecting device will now be described with reference to FIG. 8.

Figure 8:
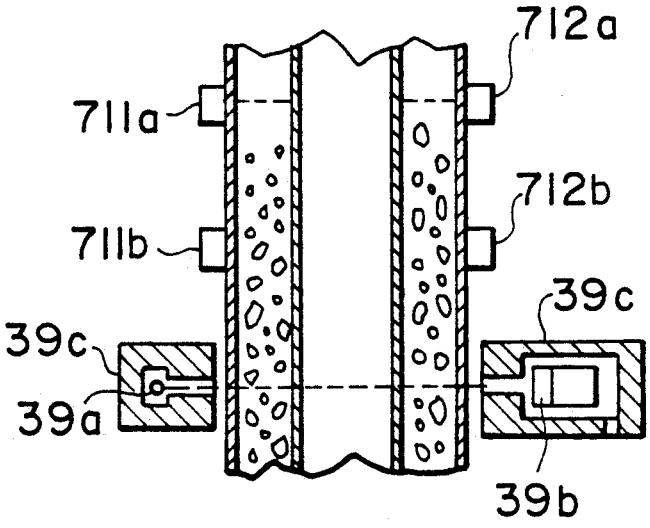
FIG. 8 is a schematic, vertical cross-sectional view showing a modification of a level detecting device shown in FIG. 9.

A level detecting device shown in FIG. 8 comprises a light-emitting diode 712*a*, a photodiode 711*a* which is disposed in horizontally opposed relation to the light-emitting diode 712*a*, a light-emitting diode 712*b* and a photodiode 711*b*. The light-emitting diodes 712*b* and the photodiode 711*b* are disposed below and spaced a predetermined distance from the light-emitting diode 712*a* and the photodiode 711*a*. With this arrangement, the amount of the fragments fed into the fragment transfer path 88 can be controlled more accurately. More specifically, when the level or height of the fragments 1 in the transfer path 88 becomes lower than the plane in which the light-emitting diode 712*b* and the photodiode 711*b* are disposed, the crushing speed of the roll mill 51 is increased so as to increase the amount of feed of the fragments 1 into the transfer path 88. When the level of the fragments 1 in the transfer path 88 becomes higher than the plane in which the light-emitting diode 712*a* and the photodiode 711*a* are disposed, the crushing speed of the roll mill 51 is decreased so as to decrease the amount of feed of the fragments 1 into the transfer path 88.

Instead of using the combination of the light-emitting diodes and the photodiodes, the level of the fragments 1 may be detected using a combination of a radiation source and a radiation sensor, in which case the level is detected according to the transmissivity of the radiation.

A modified density detecting device shown in FIG. 8 comprises a radiation source 39*a*, a radiation sensor 39*b* disposed in horizontally opposed relation to the radiation source 39*a*, and shield containers 39*c* respectively enclosing the radiation source 39*a* and the radiation sensor 39*b*. This density detecting device utilizes an attenuation in the intensity of the radiation, and its principle is the same as that of the above level detecting device. The ratio P of the radiation transmission intensity No (which is obtained when no fragment 1 is present in the transfer path) to the radiation transmission intensity N obtained after the radiation transmits through the fragments 1 depends on the average density p of the fragments 1 (P=N/No). The final radiation value Ao of the fragments 1 is represented by the following formula:

$$Ao = A/\rho(P)$$

where A represents the value of the fragments 1 measured by the radiation detectors 2.

The relation between P and $\rho$ greatly varies depending on the measurement system; however, when this system is determined, the relation can be decided empirically.

In the above embodiments, although the density of the fragments 1 is determined by the amount of transmission of the radiation, the detection also can be similarly made utilizing the amount of transmission of ultrasonic waves. In the case where the level detecting device is of the type utilizing radiation, the level detecting device shown in FIG. 8 can also serve as a density detecting device.

Figure 9:
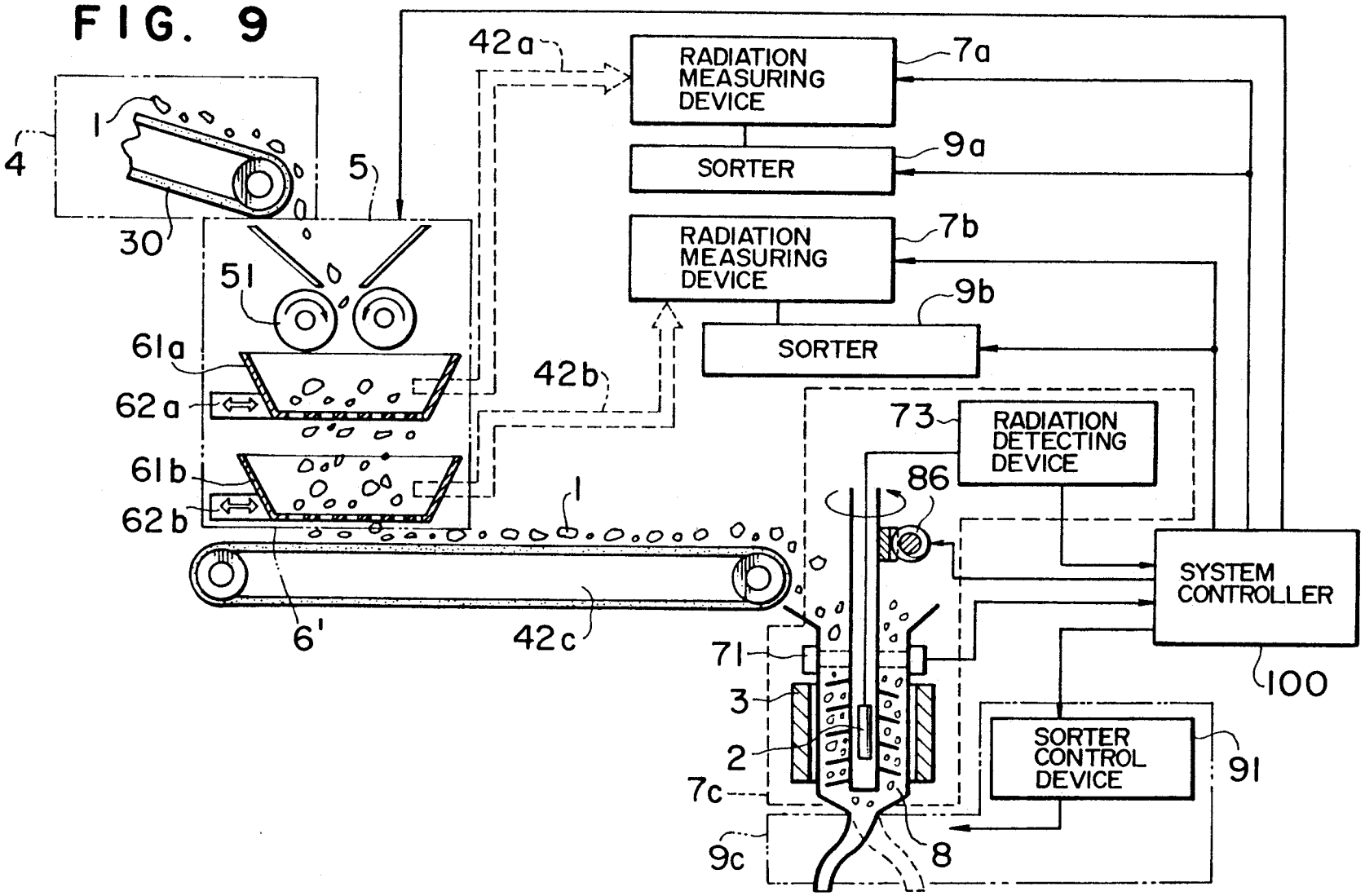
FIG. 9 is a schematic view of a second embodiment of a fragment-discriminating system of the present invention.

A second preferred embodiment of a fragmented material-discriminating system of the present invention will now be described with reference to FIG. 9.

The fragmented material 1 is conveyed from the place where the material is broken into fragments, and is charged into a crusher 5 where the fragmented material 1 is further crushed into smaller fragments or particles. A selector 6' is disposed below a roll mill 51 of the crusher 5. The selector 6' comprises two screens 61*a* and 61*b* of different mesh sizes, and the screen 61*a* of a greater mesh size is disposed above the screen 61*b*. Vibrators 62*a* and 62*b* are connected respectively to the two screens 61*a* and 61*b* so as to vibrate them horizontally. A belt conveyor 42*a* is connected to the screen 61*a* so as to convey those fragments 1 of a particle size greater than the mesh size of the screen 61*a*. A belt conveyor 42*b* is connected to the screen 61*b* so as to convey those fragments 1 having a particle size which is smaller than the mesh size of the screen 61*a* but greater than the mesh size of the screen 61*b*. Mounted below the screen 61*b* is a belt conveyor 42*c* for conveying those fragments 1 of a particle size smaller than the mesh size of the screen 61*b*. Radiation measuring devices 7*a*, 7*b* and 7*c* are associated with the belt conveyors 42*a*, 42*b* and 42*c*, respectively. Sorters 9*a*, 9*b* and 9*c* are associated with the radiation measuring devices 7*a*, 7*b* and 7*c*, respectively. A system controller 100 is provided for controlling the radiation measuring devices 7*a*, 7*b* and 7*c* and the sorters 9*a*, 9*b* and 9*c*.

The fragmented material 1 fed into the roll mill 51 is further crushed, and is fed onto the screen 61*a*. Those fragments 1 of a particle size greater than the mesh size of the screen 61*a* are conveyed by the conveyor 42*a* to the radiation measuring device 7*a* where the radiation of such fragments 1 is measured. The result of this measurement is fed to the system controller 100 where it is converted into a radioactive concentration. In accordance with the detected radioactive concentration, the system controller 100 feeds an instruction signal to the sorter 9*a*, so that the sorter 9*a* discriminates the fragments 1 on the basis of a predetermined radioactive concentration. Those fragments 1 of a particle size smaller than the mesh size of the screen 61*a* but greater than the mesh size of the screen 61*b* are conveyed by the conveyor 42*b* to the radiation measuring device 7*b* where radiation of such fragments 1 is measured. The result of this measurement is fed to the system controller 100 where it is converted into a radioactive concentration. In accordance with the detected radioactive concentration, the system controller 100 feeds an instruction signal to the sorter 9b, so that the sorter 9b discriminates the fragments 1 on the basis of a predetermined radioactive concentration. Those fragments 1 of a particle size smaller than the mesh size of the screen 61b are conveyed by the conveyor 42c to the radiation measuring device 7c where the radiation of such fragments 1 is measured. The result of this measurement is fed to the system controller 100 where it is converted into a radioactive concentration. In accordance with the detected radioactive concentration, the system controller 100 feeds an instruction signal to the sorter 9c, so that the sorter 9c discriminates the fragments 1 on the basis of a predetermined radioactive concentration. Since the fragments 1 are beforehand classified or sorted into the three groups depending on the particle size, the density of the fragments 1 of each group can be beforehand determined. Therefore, in this second embodiment, there is no need to use the density detecting device 39 used in the first embodiment. The radiation measuring device, the sorter, etc., used in the first embodiment are also used in the second embodiment.

Although the fragmented material discriminating systems of the first and second embodiments employ the radiation measuring devices of the present invention, it is to be noted that if the density detecting device for detecting the density of the fragments is used, the measurement precision can be enhanced even with the use of the conventional radiation measuring device, though this measurement precision is lower than that achieved with the use of the radiation measuring device of the present invention.

What is claimed is:

1. A system for discriminating radiation-contaminated fragments on the basis of a predetermined radioactive concentration, comprising:

(a) detection means for detecting the radiation of said fragments, said detection means comprising means constituting a vertically extending path of transfer of said fragments, at least one radiation detector disposed at one of the inside and outside of said transfer path, and a transfer device for sequentially transferring said fragments in said vertically extending transfer path;

(b) convey means for conveying said fragments to said detection means;

(c) adjustment means for adjusting the particle size of said fragments before said fragments are conveyed to said detection means; and (d) a controller for determining the radioactive concentration of said fragments in accordance with the radiation detected by said detection means and for judging whether or not the radioactive concentration of said fragments is a predetermined radioactive concentration, said controller also being operable to control said transfer device so as to adjust the speed of transfer of said fragments in said vertically extending path.

2. A system according to claim 1, in which said detection means comprises a vertically extending outer tube, a vertically extending inner tube disposed in said outer tube to define with said outer tube said vertically extending transfer path of an annular cross-section between said inner and outer tubes, and a support tube inserted in said inner tube in such a manner that a peripheral wall of said support tube is held spaced apart from a peripheral wall of said inner tube, and said radiation detector being retained in said support tube.

3. A system according to claim 1, in which said detection means comprise a tube whose interior defines said transfer path, a plurality of said radiation detectors being arranged around said tube.

4. A system according to claim 2 or claim 3, further comprising a density detecting device for detecting the density of said fragments to be conveyed to said radiation detector, said controller correcting said determined radioactive concentration by the density detected by said density detecting device.

5. A system according to claim 4, in which said density detecting means comprises a television camera for picking up the image of said fragments on said convey means, and an image processing device for determining the average particle size of said fragments from said image picked up by said television camera.

6. A system according to claim 4, in which said density detecting means comprises a radiation source housed in a shield container, and a radiation sensor housed in another shield container and disposed in opposed relation to said radiation source.

7. A system according to claim 2 or claim 3, further comprising a level detecting device for detecting the level of said fragments in said vertically extending transfer path, and wherein said adjustment means includes a roll mill for crushing said fragments, said controller controlling the operation of said roll mill in accordance with the level detected by said level detecting device so that the crushing speed of said roll mill is adjusted.

8. A system according to claim 7, in which said level detecting device comprises a light-emitting diode provided at the upper portion of said transfer path, and a photodiode disposed in horizontally opposed relation to said light-emitting diode.

9. A system according to claim 8, in which said level detecting device also comprises another light-emitting diode and another photodiode disposed in horizontally opposed relation to said another light-emitting diode, said another light-emitting diode and said another photodiode being disposed below and space a predetermined distance from said first-mentioned light-emitting diode and photodiode.

10. A system according to claim 2, in which said inner tube is rotatable about an axis thereof, said transfer device including a spiral blade fixedly mounted on the outer peripheral surface of said inner tube.

11. A system according to claim 2, in which said outer tube is rotatable about an axis thereof, said transfer device including a spiral blade fixedly mounted on the inner peripheral surface of said outer tube.

12. A system according to claim 2 or claim 3, in which said transfer device includes a horizontal plate disposed below said transfer path, said horizontal plate being movable vertically.

13. A system according to claim 1, further comprising a sorter responsive to a signal from said controller so as to sort said fragments, discharged from said detection means, on the basis of said predetermined radioactive concentration.

14. A system according to claim 13, in which said sorter comprises a pivotally movable bucket disposed below said transfer path.

15. A system according to claim 13, in which said sorter comprises a hopper disposed below said transfer path, said hopper being reciprocally movable in a first direction and also in a second direction perpendicular to said first direction.

16. A system according to claim 13, in which said sorter comprises a flat plate disposed below said transfer path, said flat plate being angularly movable about an axis extending parallel to the plane of said flat plate and passing through the center of said flat plate.

17. A system according to claim 13, in which said sorter comprises a flexible tube connected to the lower end of said transfer path, and a device for changing the bending of said flexible tube.

18. A system according to claim 1, in which said adjustment means comprises a screening device for allowing those fragments of below a predetermined particle size to pass therethrough onto said convey means.

19. A system for discriminating radiation-contaminated fragments on the basis of a predetermined radioactive concentration, comprising:

(a) a selector for dividing said fragments into a plurality of groups depending on the particle size of said fragments;

(b) a plurality of detection means for detecting the radiations of said groups of said fragments, respectively, each of said plurality of detection means comprising means constituting a vertically extending path of transfer of the corresponding group of said fragments, at least one radiation detector disposed at one of the inside and outside of said transfer path, and a transfer device for sequentially transferring the corresponding group of said fragments in said vertically extending transfer path;

(c) a plurality of convey means for conveying said groups of said fragments to their corresponding detection means, respectively; and (d) a controller for determining the radioactive concentration of each group of said fragments in accordance with the radiation detected by respective one of said detection means and for judging whether or not the radioactive concentration of each group of said fragments is a predetermined radioactive concentration, said controller also being operable to control each of said transfer devices so as to adjust the speed of transfer of the corresponding group of said fragments in said transfer path.

20. A system according to claim 19, in which each of said plurality of detection means comprises an outer tube, an inner tube disposed in said outer tube to define with said outer tube said vertically extending transfer path of an annular cross-section between said inner and outer tubes, and a support tube inserted in said inner tube in such a manner that a peripheral wall of said support tube is held spaced apart from a peripheral wall of said inner tube, and said radiation detector being retained in said support tube.

21. A system according to claim 20, in which said inner tube is rotatable about an axis thereof, each of said transfer devices including a spiral blade fixedly mounted on the outer peripheral of said inner tube.

22. A system according to claim 20, in which said outer tube is rotatable about an axis thereof, each of said transfer device including a spiral blade fixedly mounted on the inner peripheral surface of said outer tube.

23. A system according to claim 19, in which each of said plurality of detection means comprises a tube whose interior defines said transfer path, a plurality of said radiation detectors being arranged around said tube.

24. A system according to claim 20 or claim 23, further comprising a plurality of sorter means associated respectively with said plurality of detection means, each sorter means being responsive to a signal from said controller so as to sort the corresponding group of said fragments, discharged from the corresponding detection means, on the basis of said predetermined radioactive concentration.

25. A system according to claim 24, in which each of said sorter means comprises a pivotally movable bucket disposed below said transfer path.

26. A system according to claim 24, in which each of said sorter means comprises a hopper disposed below said transfer path, said hopper being reciprocally movable in a first direction and also in a second direction perpendicular to said first direction.

27. A system according to claim 24 in which each of said sorter means comprises a flat plate disposed below said transfer path, said flat plate being angularly movable about an axis extending parallel to the plane of said flat plate and passing through the center of said flat plate.

28. A system according to claim 24, in which each of said sorter means comprises a flexible tube connected to the lower end of said transfer path, and a device for changing the bending of said flexible tube.

29. A system according to claim 20 or claim 23, further comprising a plurality of level detecting devices for respectively detecting the levels of said groups of said fragments in the respective transfer paths, and a plurality of roll mills for crushing said groups of said fragments, respectively, said controller controlling the operation of each of said roll mills in accordance with the level detected by respective one of said level detecting devices so that the crushing speed of said roll mill is adjusted.

30. A system according to claim 29, in which each of said level detecting devices comprises a light-emitting diode provided at the upper portion of said transfer path, and a photodiode disposed in horizontally opposed relation to said light-emitting diode.

31. A system according to claim 29, in which each of said level detecting devices also comprises another light-emitting diode and another photodiode disposed in horizontally opposed relation to said another light-emitting diode, said another light-emitting diode and said another photodiode being disposed below and spaced a predetermined distance from said first-mentioned light-emitting diode and photodiode.

32. A system according to claim 20 or claim 23, in which each of said transfer devices comprises a horizontal plate disposed below said transfer path, said horizontal plate being movable vertically.

33. A system for discriminating radiation-contaminated fragments on the basis of a predetermined radioactive concentration, comprising:

(a) detection means for detecting the radiation of said fragments;

(b) convey means for conveying said fragments to said detection means;

(c) density detecting means for detecting the density of said fragments to be conveyed to said detection means; and (d) a controller for determining the radioactive concentration of said fragments in accordance with the radiation detected by said detection means and the density detected by said density detecting means and for judging whether or not the radioactive concentration of said fragments is a predetermined radioactive concentration, wherein said density detecting means comprises a television camera for picking up the image of said fragments on said convey means, and an image processing device for determining the average particle size of said fragments from said image picked up by said television camera.

34. A system according to claim 33, further comprising adjustment means for adjusting the particle size of said fragments before said fragments are conveyed to said detection means.

35. A system according to claim 34, in which said adjustment means includes a screening device for allowing those fragments of below a predetermined particle size to pass therethrough onto said convey means.

36. A system for discriminating radiation-contaminated fragments on the basis of a predetermined radioactive concentration, comprising:

(a) detection means for detecting the radiation of said fragments;

(b) convey means for conveying said fragments to said detection means;

(c) density detecting means for detecting the density of said fragments to be conveyed to said detection means; and (d) a controller for determining the radioactive concentration of said fragments in accordance with the radiation detected by said detection means and the density detected by said density detecting means and for judging whether or not the radioactive concentration of said fragments is a predetermined radioactive concentration and wherein said density detecting means comprises a radiation source housed in a shield container, and a radiation sensor housed in another shield container and disposed in opposed relation to said radiation source.

37. Apparatus for measuring the radioactivity of radiation-contaminated fragments, comprising:

(a) means constituting a vertically extending path of transfer of said fragments;

(b) at least one radiation detector disposed at one of the inside and outside of said vertically extending transfer path;

(c) a transfer device for sequentially transferring said fragments in said vertically extending transfer path; and (d) a controller for determining the radioactive concentration of said fragments in accordance with the radiation detected by said detection means and for judging whether or not the radioactive concentration of said fragments is a predetermined radioactive concentration, said controller also being operable to control said transfer device so as to adjust the speed of transfer of said fragments in said vertically extending transfer path and wherein there are provided an outer tube, an inner tube disposed in said outer tube to define with said outer tube said vertically extending transfer path of an annular cross-section between said inner and outer tubes, and a support tube inserted in said inner tube in such a manner that a peripheral wall of said support tube is held spaced apart from a peripheral wall of said inner tube, and said radiation detector being retained in said support tube.

38. Apparatus according to claim 37, further comprising a level detecting device for detecting the level of said fragments in said transfer path.

39. Apparatus according to claim 38, in which said level detecting device comprises a light-emitting diode provided at the upper portion of said transfer path, and a photodiode disposed in horizontally opposed relation to said light-emitting diode.

40. Apparatus according to claim 39, in which said level detecting device also comprises another light-emitting diode and another photodiode disposed in horizontally opposed relation to said another light-emitting diode, said another light-emitting diode and said another photodiode being disposed below and spaced a predetermined distance from said first-mentioned light-emitting diode and photodiode.

41. Apparatus according to claim 37, in which said inner tube is rotatable about an axis thereof, said transfer device including a spiral blade fixedly mounted on the outer peripheral surface of said inner tube.

42. Apparatus according to claim 37, in which said outer tube is rotatable about an axis thereof, said transfer device including a spiral blade fixedly mounted on the inner peripheral surface of said outer tube.

43. Apparatus according to claim 37, in which said transfer device comprises a horizontal plate disposed below said transfer path, said horizontal plate being movable vertically.

44. Apparatus according to claim 37, in which said transfer device comprises a flexible tube connected to the lower end of said transfer path, and a device for changing the bending of said flexible tube.

* * * * *